United States Patent [19]

Frank

[11] Patent Number: 4,562,851

[45] Date of Patent: Jan. 7, 1986

[54] HOLDING FIXTURE FOR EXCHANGEABLE SOLE PIECES FOR WALKING AIDS

[75] Inventor: Xaver Frank, Lengenwang, Fed. Rep. of Germany

[73] Assignee: S & F Orthopadietechnik GmbH, Gorisried, Fed. Rep. of Germany

[21] Appl. No.: 559,228

[22] Filed: Dec. 8, 1983

[30] Foreign Application Priority Data

Dec. 10, 1982 [EP] European Pat. Off. ..... 8211480.8
Aug. 26, 1983 [EP] European Pat. Off. ..... 83108427.2

[51] Int. Cl.[4] ..... A45B 9/04; A61H 3/02
[52] U.S. Cl. ..... 135/78; 135/84
[58] Field of Search ..... 135/77, 78, 79, 80, 135/81, 82, 83, 84, 85, 86, 44, 69, 68, 70

[56] References Cited

U.S. PATENT DOCUMENTS 254,348 2/1882 Maine ..... 135/86 X
619,235 2/1899 Schwarting ..... 135/80

FOREIGN PATENT DOCUMENTS 311429 3/1919 Fed. Rep. of Germany ..... 135/77
452583 11/1927 Fed. Rep. of Germany ..... 135/78
486785 11/1929 Fed. Rep. of Germany ..... 135/78
826186 12/1951 Fed. Rep. of Germany ..... 135/77

*Primary Examiner*—Robert A. Hafer
*Assistant Examiner*—Arnold W. Kramer

[57] ABSTRACT

What is described is a holding fixture for an exchangeable sole piece in walking aids, for example crutches or the like, having a support pod and a bottom mounting rim to which a sole piece is releasably attached. The sole piece (4) is affixed secure against being pulled off by means of a push-on sleeve (12) that can be slid fittingly over the mounting rim (8) and the push-on sleeve is attached to the support pod (3) and secured against being pulled off by a snap lock mechanism (14). The fixture has the special advantage that the exchange of the sole piece can be carried out extremely quickly and comfortably and that a maximum of operational reliability of the holding fixture is guaranteed.

50 Claims, 9 Drawing Figures

$y_A$
121'
127'
123'
12'
13'
4
30
27
26
25
VIII
4
25
129'
122'
42
126'
128'
IX
126'

124'
126'

HOLDING FIXTURE FOR EXCHANGEABLE SOLE PIECES FOR WALKING AIDS

The invention relates to a fixture for holding exchangeable sole pieces in the support pods of walking aids in which the sole piece is either screwed or pressed into the edge of a mount in the support pod or else is pushed over the lower end of the support pod like a cap.

All of these known solutions have disadvantages because the exchange usually requires special tools, e.g. special removal tools, screwdrivers or wrenches and because the sole piece is subjected to relatively high stresses during such removal and will fatigue eventually and also because the exchange process requires relatively much time. Especially if the handicapped person must travel along ground surfaces of different types in rapid sequence, e.g. in the winter, on ice or stone surfaces having greatly different frictional properties, the tedious exchange of the sole piece is an additional burden for the handicapped person who often chooses not to exchange the sole piece and thus greatly reduces his safety of movement.

Basic to the invention is the problem of providing a holding fixture permitting rapid and comfortable exchange of the sole piece and assuring reliable operation over prolonged periods of time.

The invention comprises a snap-on lock which can be operated with a minimum of force and can be released in minimum time without requiring any kind of tool. Therefore, the sole piece can be exchanged with the least amount of effort. Beyond easy operation, the handicapped person is able to avoid being soiled, making the exchange or replacement still easier.

According to the invention, it is not the sole piece itself, but a push-on form-fitting sleeve which holds the sole piece on the support pad in releasable relationship to the edge of the mounting so that the snap lock can be designed for the specific requirements that it must meet without consideration of the form or properties of the sole piece which is stressed only negligibly during the exchange. Thus, the region of the snap lock can be embodied with a view to the greatest resistance to wear and operational reliability and the region of the sole piece can be embodied with a view to optimum force transfer from the ground to the walking aid, independently of one another and in optimum fashion.

Especially if the support pod is connected to the support rod of the walking aid by a ball-joint, the snap lock can be of very simple construction because, in that case, it is subject only to exactly defined and limited axial tensile forces and not to any moments. This further enhances the operational reliability and life of the snap lock.

The holding fixture is equally advantageous for fastening a sole piece embodied as a reversible element as one which has a saucer-like bottom surface. In this way, the holder according to the invention has universal applicability in that the mounting flange is a universal fit for diverse saucer-shaped sole pieces and serves as a bilaterally open annular sleeve that provides axial security for a reversible sole piece that is rubbery or elastic and which may have a cleat profile on one side and be equipped with spikes on the other side. As a rule, the saucer-like sole pieces are made of a material which has sufficient strength so that the push-on sleeve can be molded integrally with the sole piece.

The form fit betwen the mounting rim and the push-on sleeve works against any breakout of the holder and a substantially point-like snap lock may suffice to affix the push-on sleeve on the mounting rim with security against being pulled off.

The holding fixture can be easily operated with thumb and forefinger, completely releasing the form-fitting engagement of the locking surface sections with the corresponding undercut axial slots in the push-on sleeve so that the latter may be pulled away from the mounting rim without any resistance. The undercut axial slots are easy to produce because they extend into the upper edge of the push-on sleeve. The snap pins can have relatively large heads without hindering the snap lock security which further improves the operability of the releasable snap lock. As the release of the connection between the push-on sleeve and the mounting rim takes place only during simultaneous actuation or compression of the two snap pins, the functional reliability of the holding fixture is further increased. An unintentional impact of the support pod against some object causing, for example, the actuation of one snap pin and moving it into the release position still will not cause a complete release of the snap lock because the other snap pin remains in its form-fitting contact with the other undercut axial slot. Therefore, this fixture can also be used in all cases where any two elements that are in axial alignment must be relesably coupled so as to be secure against pull-out and protected from disturbing forces.

A cylindrical form for the guide surface sections, the locking surface sections and the release surface sections insures that the guiding surfaces in the support pod may have a simple geometrical shape. Moreover, the cylindrical locking and release surface sections contribute to an easier passage of the undercut axial slots past the snap pins. Thus, the cylindrical surface sections of the snap pins gradually bring the undercut axial slots into exact axial alignment with the snap pins.

A further embodiment secures the snap pins against falling out and also assigns to each of them an exactly defined locking position independently of that assigned to the other. As the forces acting on the push-on sleeve act in a direction which is perpendicular to the direction of motion of the snap pins, the compression spring which biases the snap pins may be very weak, making the operation of the fixture still easier. The pin which extends into the diametric bore performs a stop function in the simplest possible form, yet in reliable manner. Such a pin may be inserted, for example, into the support pod in a direction parallel to the axis of the push-on sleeve and may cooperate with a machined recess in the snap pins in the guide surface section.

An axial push-on motion of the push-on sleeve results in an automatic lock of the snap lock mechanism.

In addition the structure permits the motion of pushing the sleeve over the mounting and reduces the wear on the snap lock.

In that case, the push-on sleeve may be pushed onto the mounting rim with relatively poor alignment of its axial slots relative to the snap pins yet the further axial displacement will result in an adjustment of the alignment as well as automatic depression of the snap pins to complete a hold that is secure against pull-out.

If the pin head is fitted to move within a recess in the push-on sleeve and covers the undercut axial slot, the danger of soiling the snap lock is reduced considerably, thereby further enhancing the functional reliability of the holding fixture.

In the locking position, the snap pin must protrude from the mounting rim or the support pod by an amount equal to the sum of the widths or heights of the pin head, the adjacent unlocking section, a conical section if present and the locking surface section. Accordingly, when the push-on sleeve is a hollow cylinder having relatively thin walls in order to conserve weight, then it is not possible to accommodate the pin heads entirely within the push-on sleeve. Accordingly the pressure pins are accommodated completely within the outer jacket surface of the push-on sleeve, in a particularly advantageous manner and without having to change the dimensions or the weight of the fixture. Even so, there remains a very large tolerance for dimensioning the width of the locking and unlocking surface sections of the snap pins. Depression of the pin heads, achieved in a simple way, prevents any unintentional impact of the pin heads on some object; even when the support pod sinks into snow or morass or the like, no compressive force is able to act upon the snap pins. This further embodiment has the additional advantage that no dirt can enter from outside to reach the functional surface sections of the snap pins.

The invention will be described in greater detail hereinbelow with the aid of the schematic drawing in which.

Figure 1:
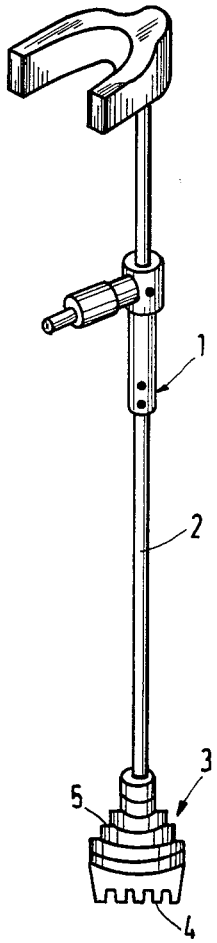
FIG. 1 is a perspective view of a crutch with exchangeable sole piece.
Figure 3:
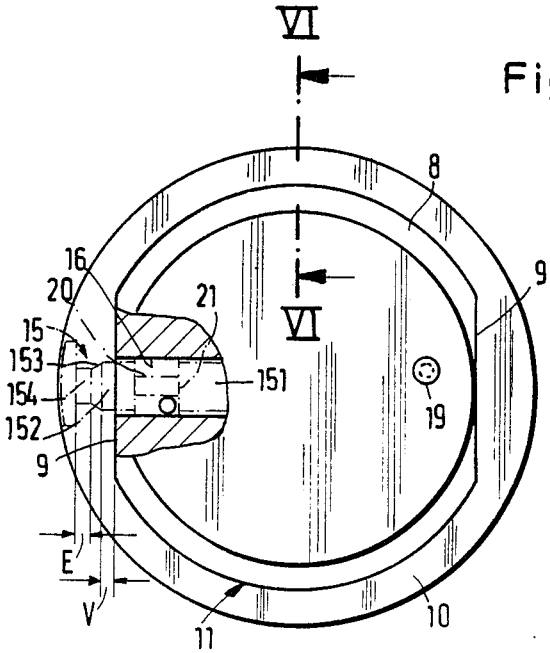
FIG. 3 is a view of the support pod from below with the push-on sleeve removed and without a sole piece, looking in the direction of the arrow III in FIG. 2.

FIG. 1 shows a crutch 1 having a support tube 2 and a support pod 3 to which is fastened an exchangeable sole piece 4. The sole piece is made, for example, of a rubber-elastic block that protrudes by a certain amount beyond the bottom of the support pod plate which, in turn, is coupled to the support tube 2 either rigidly or via an articulated joint, for example, a ball joint. In the case of a ball joint coupling, an elastic bellows 5 extends from the support tube 2 to the support 3 to protect the articulated joint against the environment.

The detailed construction of the support pod may be seen from FIGS. 2–5. The support body 6 of the support pod has axial symmetry and into it is machined a ball socket 7 which stands in functional engagement with a ball element the mounting tip of which is clamped in the support tube 2 of the crutch 1. The elastic bellows 5 extends from the outside surface of the support body 6 to the ball element and provides, firstly, a screening of the ball joint surfaces with respect to the outside and, secondly, a restoring force acting on the easily movable ball joint to return it to the neutral central position. The support body 6 has substantially the shape of a plate having a downwardly protruding mounting rim 8 of height H8. In the embodiment shown in the figures, the mounting rim 8 is substantially annular in order to receive a sole piece 4 with lateral guidance. The mounting rim 8 may have the shape of a continous ring. The detailed drawing shows a mounting rim which is non-continuous, being interrupted at two diametrically opposed locations by plane-parallel surfaces 9 extending up to a radial flange 10 whose function will be described in more detail below.

Figure 4:
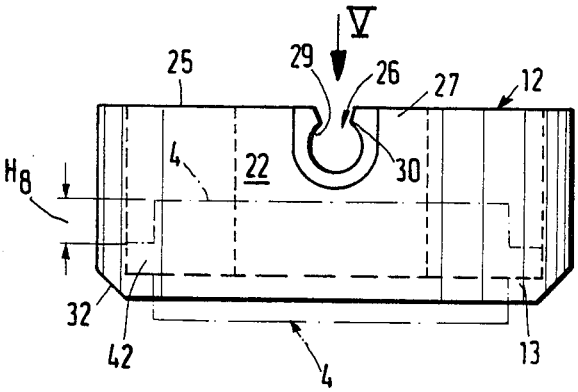
FIG. 4 is a view of the push-on sleeve shown in FIG. 2 looking along the arrow IV of FIG. 2.

The outer surface of the mounting rim 8 serves as a tolerance adaptation surface for a push-on sleeve 12 to be slid upwardly from below and serving to locate the sole piece 4 in both the lateral direction and in the axial direction of the support pod 3. The lateral positioning occurs due to suitable adaptation of the inside surface to the limiting surface of the sole piece 4, which, in the embodiment shown, has the form of a rubber-elastic reversible sole piece. On one side of the reversible sole piece, the plane parallel surface has a profile pattern 41 and the other side has steel spikes 43 embedded or molded into the elastic block. In FIG. 4, the reversible sole piece shown in dash-dotted lines has a radial flange 42 which meshes with the end face of the mounting rim 8. The lower, or bottom-most flange surface makes contact with an inwardly extending radial shoulder 13 of the push-on sleeve 12. The radial shoulder 13 secures the sole piece 4 against radial pull-off if the push-on sleeve 12 is attached to the mounting rim or the support body 6. The attachment of the push-on sleeve 12 to the support body 6 takes place by means of an externally releasable snap lock 14 which will be described in detail hereinbelow.

The snap lock consists of snap pins 15 and snap recesses 16 in the push-on sleeve 12. The snap pins 15 are received and guided in a bore 16 which goes through the support body 6 along a diameter. They are supported on one another via a spring 17 which engages respective recesses 18 of the snap pins 15, for example. The spring 17 causes the snap pins 15 to be pressed outwardly into a locking position illustrated in FIGS. 2 and 3 and defined by a stop member.

In the embodiments shown in the drawing, the stop member is formed by a pin 19 extending into the bore 16 and so located as to be in contact with a radial shoulder 21 of an undercut 20 of the snap pins 15 when the latter are in their locking position. The pins 19 are pressed from below toward the support surface of the support body 6 and the heads of the pins 19 are embedded in the support body 6. The snap pins exhibit several axially sequential functional sections: Relative to the central axis of the support pod, the radially inwardmost section is a guide section 151. Adjacent to the undercut 20 lies a locking surface section 152 which is shown to be cylindrical in the illustrated embodiment, followed by a conical section 153 which becomes an unlocking section 154 that is followed, in turn, by a pin head 155. In the locking position of the snap pins, the locking surface section 152 protrudes beyond the plane surface 9 of the support body 6 by an amount V. By compressing the pin head 155, the snap pin 15 can be pushed against the force of the spring 17 and caused to enter the diametric bore 16 far enough that the locking section 152 and the conical section 153 come to lie within the support body 6. In the unlocked position of the snap pins 15, the unlocking sections 154 thus lie immediately adjacent the plane surfaces 9.

In order to be adapted to the form of the snap pins 15, the push-on sleeve, whose inside surface has circumferential form-fitting contact with the mounting rim 8, also exhibits plane surfaces 22 at diametrically opposite points and these surfaces 22 stand in guiding engagement with the plane surfaces 9 of the support body 6. Therefore, the region of these plane surfaces 22 in the push-on sleeve 12 has an accumulation of material 23 of sufficient bulk S to permit the pin heads 155 to come to lie radially inward of the outer surface of the push-on sleeve 12 when the snap pins 15 are in their locking position. Suitably, the outer surfaces of the pinheads 155 are flush with the cylindrical outer surface of the push-on sleeve 12.

The sleeve 12 is symmetric with respect to a plane 24 that coincides with the central plane of the diametric bore 16 of the support body 6 when the sleeve 12 is pushed into place. Undercut axial grooves 26 are formed or machined into the sleeve starting at the upper edge 25 and extending symmetrically with respect to the plane 24. These undercuts are matched geometrically to the shape of the snap pins 15. The undercut axial slot 26 has a radial extent T, equal to approximately one third of the dimension S and substantially equal to the dimension V but which, in no case, is greater than the axial extent E of the unlocking surface section 154. Adjacent to the axial slot 26 is a radial external recess 27 which receives a respective pinhead 155 in form-fitting manner. The recess 27 has a stop shoulder 28 against which the inside surface of the pinhead 155 is pushed for unlocking the snap lock 14.

The undercut axial slot 26 has an undercut surface 29, formed by a partial cylindrical surface and serves to receive the locking surface section 152 of the snap pin 15 in form-fitting manner. The undercut surface 29 forms an upper throat section 30 whose width W is somewhat greater than the thickness or the diameter of the unlocking surface section 154 of the associated snap pin 15. Beginning with the throat section 30, the axial slot 26 becomes slightly larger toward the upper edge 25 of the push-on sleeve 12, in order to facilitate the travel of the snap pins 15 in the axial slots 26 during the snap-in phase.

Figure 2:
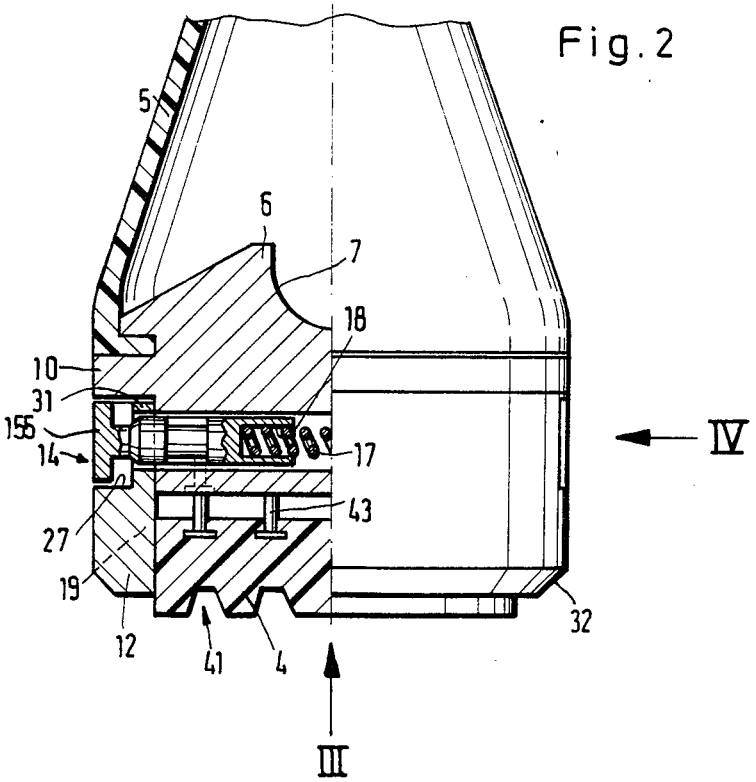
FIG. 2 is a partial axial section of a support pod of a crutch.
Figure 6:
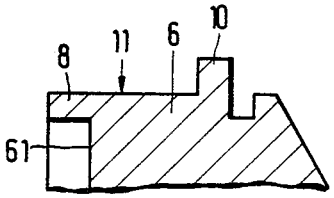
FIG. 6 is a partial view of the support element sectioned along the line VI—VI in FIG. 3.
Figure 5:
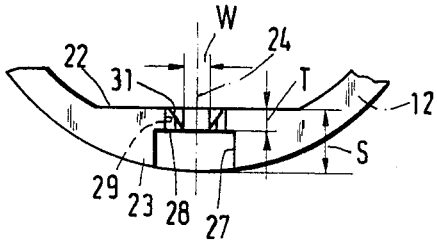
FIG. 5 is a partial view of the push-on sleeve shown in FIG. 4 seen along the arrow V in FIG. 4.

In order to insure the automatic functioning of the snap locking mechanism when the push-on sleeve 12 is pushed over the mounting rim 8 of the support body 6 without requiring manual depression of the pinheads 155, the region of the undercut axial slots 26 where the axial slot becomes slightly enlarged starting at the throat 30 to the upper edge 25 has radially inwardly pointing, wedge-like bevels 31, visible in FIGS. 2 and 5. When the push-on sleeve 12 is sliding over the mounting rim 8, these bevels 31 initially make contact with the conical surfaces 153 of the snap pins 15 and push them into the diametric bore 16 until the unlocking surface sections 154 can pass through the narrow throat area 30 of the axial slot 26. When the sleeve 12 has been fully pushed onto the mounting rim 8, the pins 15 snap outwardly under the influence of the spring 17 and their locking surface sections 152 engage the undercut 29 in form-fitting manner.

In order to prevent chattering of the snap lock 14, the undercut surfaces 29 cooperate with the locking surface sections 152 in such a way that, in the locking position, the sleeve 12 is urged downwardly in elastic manner. When a rubber-like, elastic reversible element 4 (as shown) is being mounted, for example, then this biasing may occur in that the axis of the undercut 29 can be brought into alignment with the central axis of the diametric bore 16 only after the annular shoulder 42 of the reversible body 4 has been deformed by a small, defined amount in the axial direction by the inwardly facing annular shoulder 13 of the sleeve 12.

In the embodiment shown, the reversible body 4 is supported on the support body by both its radial flange 42 and the plane surface facing away from the ground. However, the support may also be created by the steel pins 43 although, in that case, care should be taken that these spikes do not press into the plane support surface 61 of the support body 6.

The drawing shows clearly that the snap lock or snap coupling 14 is reliably protected against contamination by the form-fit of the pinhead 155 with the recess 27 and also in that the upper edge 25 makes a flush closure with the annular shoulder 10 of the support body 6, so that the above-described holding fixture functions reliably even when used in soft terrain.

The fixture is suitable not only for releasably mounting exchangeable cylindrical sole pieces, but also especially for securing dish-shaped extended support bodies of the kind used to special advantage if the handicapped person must travel on very soft-surfaced ground. In that case, the push-one sleeve is rigidly attached to or made integral with the sole piece but is otherwise constructed in the same way as described above. The force of support passes from the sole piece into the support body 6 via the upper edge 25 and the radial shoulder 10 of the support body and/or the end face of the mounting rim 8, in that case.

If the support body 6 is coupled to the support tube by a ball joint, then the push-on sleeve 12 can be extended downwardly relatively far so that the sole piece protrudes beyond the radial shoulder 13 only by a few millimeters.

In that case, the support pod can be emplaced reliably using the entire area of the sole piece, due to the action of the ball joint, provided only that the sleeve 12 has a small bevel 32 at its lower end.

A suitable material for the push-on sleeve and the snap pins is either aluminum or form-stable synthetic material, such as HDPE (High Density Poly-Ethylene) plastic, for example. In that way, the support pod is very light so that the handicapped person is not tired too rapidly even when taking extended walks with a dish-shaped, large area sole piece.

In the unlocked position of the snap pins, the axial pins 19 preferably make contact with the other radial shoulder of the machined recess 20 so that, in this case as well, the snap pins are in a well-defined position that can be maintained without exerting stresses on the push-on sleeve.

Figure 7:
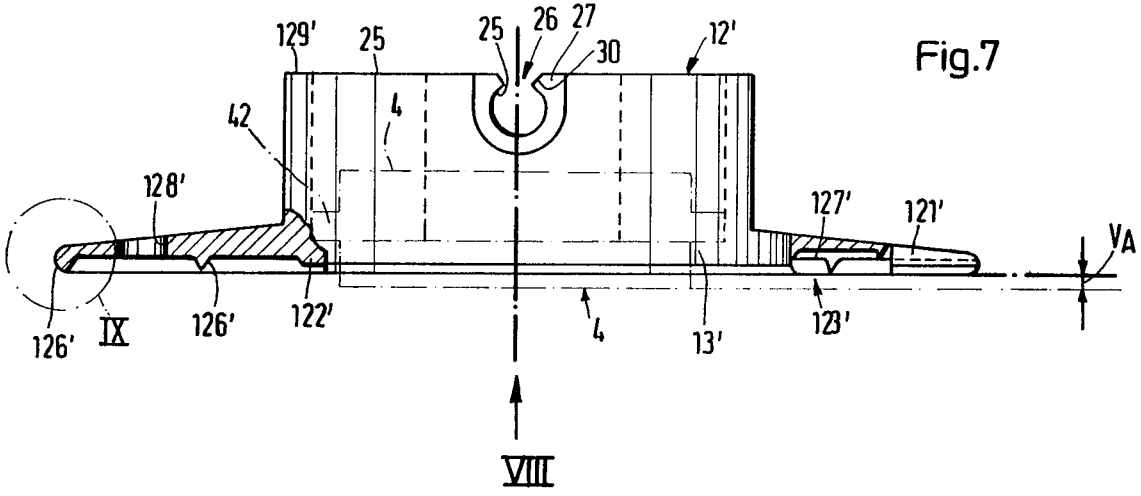
FIG. 7 is a view similar to that of FIG. 4 of a further embodiment of the invention.
Figure 9:
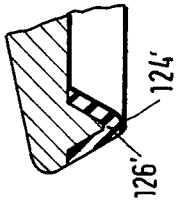
FIG. 9 is an enlarged view of the detail "IX" in FIG. 7 of a further embodiment of the push-on sleeve.
Figure 8:
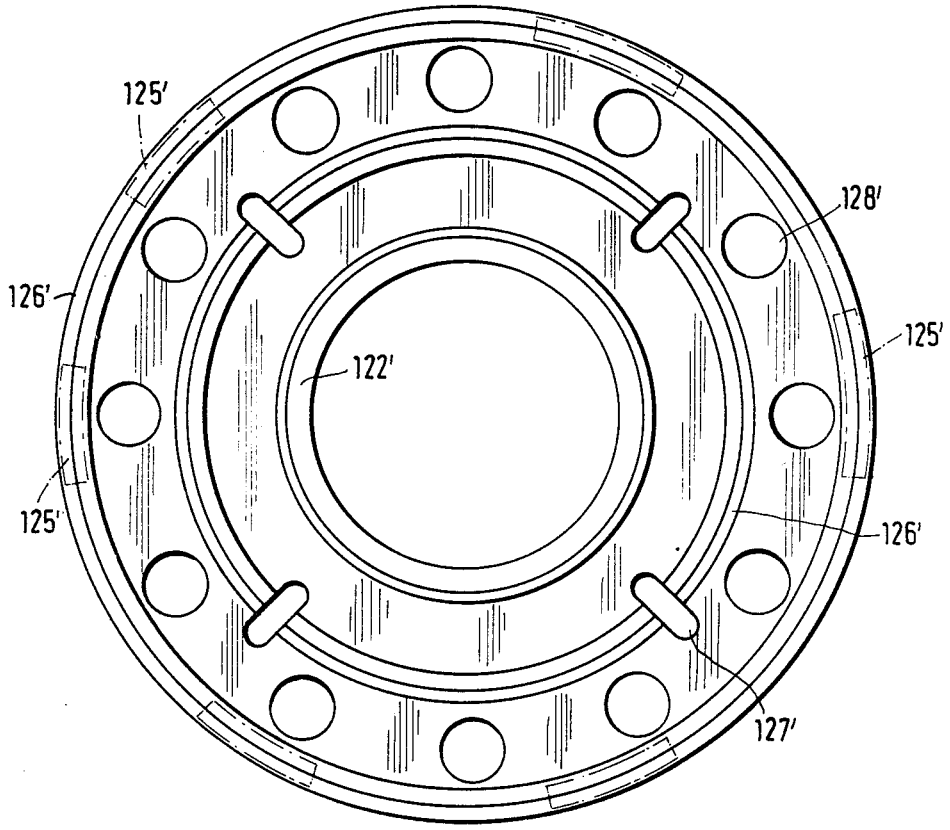
FIG. 8 is a view of the push-on sleeve of FIG. 7 seen from below (direction VIII)

FIGS. 7 to 9 show another embodiment of the push-on sleeve. This variant carries the reference number 12'. In the upper region and in the interior, the construction is identical to the previously described sleeve 12, so that a detailed explanation is unnecessary. When the construction is identical, the same reference numbers are used for both embodiments.

The push-on sleeve 12' shown in FIGS. 7 to 9 differs from that described above mainly by a flange section that extends from a lower end face 122' of the sleeve 12' and going outwardly substantially in a radial plane. Preferably, the flange 121' is formed by a pure, i.e., exact radial flange which is made integral with the cylindrical body of the preferably plastic sleeve 12'. The radial flange 121' does not extend axially beyond the end face 122' and its outside diameter is substantially equal to 2–4 times the diameter of the sole piece 4 to be received inside the push-on sleeve 12' and embodied, for example, as a reversible sole piece, as described in detail with reference to FIG. 2.

It will be seen from the drawing and from the above description that if, instead of the sleeve 12 shown in FIG. 2, the push-on sleeve 12' is attached to the support body 6 by means of the snap coupling 14, then there is created a support pod that still exhibits a sole piece 4 which protrudes axially beyond the sleeve 12' but which is surrounded in umbrella-like fashion by the radial flange 121'. This embodiment has the following significant advantage: such a support pod permits the handicapped person to move about safely both on solid ground and on possibly very slippery or extremely soft ground, e.g. at the beach or in bog-like terrain or in snow, without necessitating a replacement of the sole piece. For on solid ground, the burden is carried entirely by the sole piece 4 which, in its embodiment as a reversible body, can be optimally adapted to the prevailing conditions of terrain and weather by selectively turning toward the ground either its spikes-equipped surface, its patterned endface intended for normal terrain or a wet-cell surface. In so doing, the sole piece can be turned or even exchanged in the simplest possible way because the sole piece attachment mechanism remains easily accessbile. However, when the handicapped person walks over softer terrain, an occurrence that can usually not be precluded during extended promenades during free time or on vactions, then the sole piece enters the ground to a limited extent due to the relatively small support area. Yet, after only a very short penetration depth, which, moreover, can be controlled by technical design of the axial recess dimension VA, this penetration is effectively counteracted by the radial flange 121', so that, in this case, immediately after the support pod has been emplaced, the radial flange 121' and the sole piece 4 jointly absorb the support forces.

It has been found that even a radial flange whose outside diameter is twice as great as the diameter of the sole piece 4 is capable of reducing the support forces in such an effective way that the handicapped person is able to move about completely without hazard and comfortably and easily on a wet beach or in very resilient bog terrain.

The above-cited advantages are amplified when the support body 6 is coupled to the support tube 2 of the walking aid 1 via an articulated coupling 7, for example in the form of a ball joint. For, in that case, the sole piece 4 as well as the mainly radially extending flange 121' are held in unaltered position relative to the supporting ground surface during the entire movement while bending stresses of the radial flange 121' are largely prevented. That means that even with a relatively extended radial flange, the push-on sleeve 12' cannot be over-stressed because, when the support pod is emplaced and while the sole piece 4 and the radial flange are not yet aligned parallel with the ground, only very small forces are acting and because, immediately after the initiation of the support force via the support tube, the articulated joint, for example in the form of a ball joint, has the effect that the support pod makes plane-parallel contact with the ground. In this, way, the coupling between the radial flange and the push-on sleeve as well as the snap-coupling are protected to the maximum extent and the latter, especially, is unstressed to the maximum degree if the push-on sleeve 12', which is supported on the mounting rim 8 of the support body 6 via its inwardly facing annular shoulder 13' and the radial flange 42 of the reversible body 4 is able to find support with its upper end face 129' on a radial flange 10 of the support body 6, either exclusively or additionaly, after a pre-determined elastic deformation path of the sole piece 4 has been traversed.

The ball joint further makes it possible to increase the diameter of the radial flange even further without having to accept the disadvantage that, when walking on very slippery and hard ground, there would be any insecurity when the walking aid is emplaced. For the inclination of the support tube 2 of the walking aid relative to a straight line perpendicular to the ground is at most 16° to 18° even during fast walking; this angle of inclination is immediately compensated after the first contact of the outer periphery of the radial flange 121' upon initiation of the support force by the articulated coupling, for example due to the ball joint 7, so that only very small radial frictional forces act on the radial flange 121' for a short time. On smooth ground, as soon as the support force has been initiated, only the sole piece 4 carries the support force in planar fashion. The radial flange or dish 121', which, during planar contact of the sole piece 4 is held at a pre-determined distance VA, does not detract from the emplacement security of the walking aid even if it is made of very smooth and hard plastic and the crutch is to be emplaced on parquet flooring or on smooth stone floors. For, due to the above-mentioned, relatively small angle of inclination of at most 16° to 18°, even very small forces already exert on the perphery of the radial flange 121', which extends relatively far outwardly, turning moments of such magnitude that any possibly present restoring force of the ball joint, provided, for example, by the elastic protective bellows 5, is immediately overcome, i.e., before the actual support force has been initiated, and the support pod can be brought into planar contact with the ground via the gripping sole piece 4.

However, in order to insure the possibility that the walking aid equipped with the above-described push-on sleeve 12' can be emplaced on very smooth ground and at large angles of inclination with complete reliability, the underside of the radial flange 121' has a surface pattern that increases the adhesion force, for example in the form of a profiled pattern 123', which, moreover, has the task of fixing the position of the support pod laterally when walking in very soft terrain. The profiled pattern shown in FIGS. 7–9 meets this purpose by having several concentric annular lands 126' and several radial depressions 127'. In order to further improve oblique emplacement, a friction-enhancing layer 124' (see FIG. 9) may be placed on the profile pattern 123' or this layer may be replaced by a wear-resistant layer. As an alternative or in addition thereto, friction-enhancing inserts 125', indicated in FIG. 8 by dash-dotted lines, can be attached, for example releasably, on the radial flange 121'.

Because, during the entire motional phase, the push-on sleeve 12' is subjected to forces whose magnitude and direction are exactly defined and controlled, the weight of the push-on sleeve can be kept relatively low, so that the handicapped person does not become fatigued even after prolonged walking using the multi-domain support pod. For additional weight reduction, the radial flange 121' can additionally be provided with openings 128' without influencing the functional reliability of the walking aid during walks in very soft terrain. The loading conditions of the radial flange are so advantageous that it does not even have to be integral with the push-on sleeve 12', but the radial flange can also be attached in some other manner to a suitably modified push-on sleeve 12, provided that it is secured against being pulled off.

The openings 128' in the radial flange or the support dish 121' further increase the support stability in soft or resilient terrain.

As a modification of the above-described embodiment, it may be provided that the radial flange 121' does not come to lie exactly in a radial plane. Rather, geometrical changes of shape are quite possible without having to accept any reduction in the above-described advantages. For example, the flange 121' can also have substantially a frusto-conical shape.

Various modifications in structure and/or function may be made to the disclosed embodiments by one skilled in the art without departing from the scope of the invention as defined by the claims.

What is claimed is:

1. A holding fixture for exchangeable sole pieces of walking aids having a support pod with a downwardly extending bottom mounting rim to which a resilient ground engaging sole piece having a radial flange is releasably attached, the sole piece being affixed by means of a push-on sleeve having an inwardly extending radial shoulder that can be slid over both the sole piece and the mounting rim in form-fitting manner with the radial flange secured between the rim and shoulder and that said push-on sleeve is secured against being pulled off by an externally releasable snap lock mounted on the support pod and cooperating with the push-on sleeve.

2. A fixture according to claim 1, for a sole piece embodied as a reversible body and received in the mounting rim, wherein the push-on sleeve has a bottom-ward radial shoulder which secures the reversible body protruding bottom-ward from the push-on sleeve on the support pod.

3. A fixture according to claim 1, wherein the push-on sleeve has a radial flange extending substantially beyond the sole piece so as to provide additional support on soft terrain.

4. A fixture according to one of the claims 1 to 3, wherein the snap lock includes at least one snap pin guidingly received in the support pod and entering under bias and form-fittingly a snap recess of the push-on sleeve and movable from outside into a position that releases the form-fit.

5. A holding fixture according to claim 4 wherein the snap lock has two diametrically opposite snap pins guided in the support pod, said snap pins being biased elastically and radially outwardly into a locking position in which their locking surface section extends form-fittingly into respective undercut axial slots starting at the upper edge of the sleeve and from which they may be moved into an unlocking position in order to depress their locking surface sections into the support pod and when in said unlocking position, unlocking surface sections the width of which is adapted to the width of the narrow throats of the axial slots are axially aligned therewith.

6. A fixture according to claim 4 comprising the support pod which is connected to the support tube of the walking aid by an articulated coupling.

7. A fixture according to claim 4 wherein the push-on sleeve has an outwardly extending radial flange.

8. A holding fixture, according to one of claims 1 to 3, wherein the snap lock has two diametrically opposite snap pins guided in the support pod, said snap pins being biased elastically and radially outwardly into a locking position in which their locking surface section extends form-fittingly into respective undercut axial slots starting at the upper edge of the sleeve and from which they may be moved into an unlocking position in order to depress their locking surface sections into the support pod and when in said unlocking position, unlocking surface sections the width of which is adapted to the width of the narrow throats of the axial slots are axially aligned therewith.

9. A fixture according to claim 8 comprising the support pod which is connected to the support tube of the walking aid by an articulated coupling.

10. A fixture according to claim 8, wherein the snap pins have cylindrical guide sections that are received in a sole diametric bore of the support pod and that are supported on one another via a spring.

11. A fixture according to claim 10 wherein in their locking position the snap pins are urged by said spring against a stop which is formed by a pin extending into said diametric bore.

12. A fixture according to claim 10 wherein the pin head is guided fittingly in a recess of the push-on sleeve and covers the axial slot.

13. A fixture according to claim 10 wherein the axial slot becomes narrower from the upper edge of the push-on sleeve toward the narrowest throat section and, in this region, has wedge-shaped bevels which, when the push-on sleeve is being pushed on, can press the snap pins inwardly into the unlocking position.

14. A fixture according to claim 10 wherein the push-on sleeve is substantially in the form of a hollow cylinder and exhibits an accumulation of material on the inside region of the axial slots the height of which is so dimensioned that the pin heads make a substantially flush closure with the outer surface of the push-on sleeve.

15. A fixture according to claim 10 comprising the support pod which is connected to the support tube of the walking aid by an articulated coupling.

16. A fixture according to claim 10 wherein the push-on sleeve has an outwsrdly extending radial flange.

17. A fixture according to claim 10, wherein the locking surface sections and the unlocking surface sections are formed by respective cylindrical surfaces which pass into one another via a conical surface.

18. A fixture according to claim 17 wherein the pin head is guided fittingly in a recess of the push-on sleeve and covers the axial slot.

19. A fixture according to claim 17 wherein the axial slot becomes narrower from the upper edge of the push-on sleeve toward the narrowest throat section and, in this region, has wedge-shaped bevels which, when the push-on sleeve is being pushed on, can press the snap pins inwardly into the unlocking position.

20. A fixture according to claim 17 wherein the push-on sleeve is substantially in the form of a hollow cylinder and exhibits an accumulation on the inside in the region of the axial slots the height of which is so dimensioned that the pin heads make a substantially flush closure with the outer surface of the push-on sleeve.

21. A fixture according to claim 17 comprising the support pod which is connected to the support tube of the walking aid by an articulated coupling.

22. A fixture according to claim 17 wherein the push-on sleeve has an outwardly extending radial flange.

23. A fixture according to claim 8, wherein, in their locking position, the snap pins are urged by said spring against a stop which is formed by a pin extending into said diametric bore.

24. A fixture according to claim 23 wherein the locking surface sections and the unlocking surface sections are formed by respective cylindrical surfaces which pass into one another via a conical surface.

25. A fixture according to claim 23 wherein the pin head is guided fittingly in a recess of the push-on sleeve and covers the axial slot.

26. A fixture according to claim 23 wherein the axial slot becomes narrower from the upper edge of the push-on sleeve toward the narrowest throat section and, in this region, has wedge-shaped bevels which, when the push-on sleeve is being pushed on, can press the snap pins inwardly into the unlocking position.

27. A fixture according to claim 23 wherein the push-on sleeve is substantially in the form of a hollow cylinder and exhibits an accumulation of material on the inside in the region of the axial slots the height of which is so dimensioned that the pin heads make a substantially flush closure with the outer surface of the push-on sleeve.

28. A fixture according to claim 23 comprising the support pod which is connected to the support tube of the walking aid by an articulated coupling.

29. A fixture according to claim 23 wherein the push-on sleeve has an outwardly extending radial flange.

30. A fixture according to claim 8, wherein the pin head is guided fittingly in a recess of the push-on sleeve and covers the axial slot.

31. A fixture according to claim 30 wherein the axial slot becomes narrower from the upper edge of the push-on sleeve toward the narrowest throat section and, in this region, has wedge-shaped bevels which, when the push-on sleeve is being pushed on, can press the snap pins inwardly into the unlocking position.

32. A fixture according to claim 30 wherein the push-on sleeve is substantially in the form of a hollow cylinder and exhibits an accumulation of material on the inside in the region of the axial slots the height of which is so dimensioned that the pin heads make a substantially flush closure with the outer surface of the push-on sleeve.

33. A fixture according to claim 30 comprising the support pod which is connected to the support tube of the walking aid by an articulated coupling.

34. A fixture according to claim 30 wherein the push-on sleeve has an outwardly extending radial flange.

35. A fixture according to claim 8, wherein the axial slot becomes narrower from the upper edge of the push-on sleeve toward the narrowest throat location and, in this region, has wedge-shaped bevels which, when the push-on sleeve is being pushed on, can press the snap pins inwardly into the unlocking positions.

36. A fixture according to claim 35, wherein the push-on sleeve is substantially in the form of a hollow cylinder and exhibits an accumulation of material on the inside in the region of the axial slots the height of which is so diemnsioned that the pin heads make a substantially flush closure with the outer surface of the push-on sleeve.

37. A fixture according to claim 35 comprising the support pod which is connected to the support tube of the walking aid by an aritculated coupling.

38. A fixture according to claim 35 wherein the push-on sleeve has an outwardly extending radial flange.

39. A fixture according to claim 8, wherein the push-on sleeve is substantially in the form of a hollow cylinder and exhibits an accumulation of material on the inside in the region of the axial slots the height of which is so dimensioned that the pin heads make a substantially flush closure with the outer surface of the push-on sleeve.

40. A fixture according to claim 39 wherein the push-on sleeve has an outwardly extending radial flange.

41. A fixture according to claim 8 wherein the push-on sleeve has an outwardly extending radial flange.

42. A fixture according to one of the claims 1 to 3 wherein the support pod is connected to the support tube of the walking aid by an articulated coupling.

43. A fixture according to claim 42 wherein the push-on sleeve has an outwardly extending radial flange.

44. A fixture according to one of the claims 1 or 2, wherein the push-on sleeve has an outwardly extending radial flange.

45. A fixture according to claim 44, wherein the radial flange is transformed substantially flush into a bottom-ward end face of the push-on sleeve from which the sole piece protrudes.

46. A fixture according to claim 45 wherein the radial flange is an integral part of the push-on sleeve which can be supported at the top on a support body of the support pod.

47. A fixture according to claim 45 wherein the radial flange has an outside diameter equal to 2 to 4 times the diameter of the sole piece and has a bottom surface pattern that increases adhesion, for example a profiled pattern and/or a covering and/or frictional inserts.

48. A fixture according to claim 44, wherein the radial flange is an integral part of the push-on sleeve which can be supported at the top on a support body of the support pod.

49. A fixture according to claim 48 wherein the radial flange has an outside diameter equal to 2 to 4 times the diameter of the sole piece and has a bottom surface pattern that increases adhesion, for example a profiled pattern and/or a covering and/or frictional inserts.

50. A fixture according to claim 44, wherein the radial flange has an outside diameter equal to 2 to 4 times the diameter of the sole piece and has a bottom surface pattern that increases adhesion, for example a profiled pattern and/or a covering and/or frictional inserts.

* * * * *